US005131715A

United States Patent [19]

Balles

[11] Patent Number: 5,131,715

[45] Date of Patent: Jul. 21, 1992

[54] MOBILE CHAIR APPARATUS

[76] Inventor: Rosemary K. Balles, P.O. Box 75, Eugene, Mo. 65032

[21] Appl. No.: 675,855

[22] Filed: Mar. 27, 1991

[51] Int. Cl.[5] ..... A61H 3/04

[52] U.S. Cl. ..... 297/5; 297/417; 297/218; 297/464; 297/DIG. 4; 297/118; 297/148

[58] Field of Search ..... 297/5, 6, 45, 417, 218, 297/148, DIG. 4, 464, 118, 129; 135/67; 272/70.3, 70 A, 144, 143, 704

[56] References Cited

U.S. PATENT DOCUMENTS

| | | | |
|---|---|---|---|
| 1,361,102 | 12/1920 | Scott | 297/5 X |
| 1,448,783 | 3/1923 | Blewitt et al. | 297/DIG. 4 X |
| 2,305,249 | 12/1942 | Frost | 297/6 |
| 2,798,533 | 7/1957 | Frank | 297/6 |
| 3,145,048 | 8/1964 | Dowdy et al. | 297/5 |
| 3,635,522 | 1/1972 | Kerwitt | 297/118 X |
| 4,155,416 | 5/1979 | Ausmus | 297/DIG. 10 X |
| 4,512,607 | 4/1985 | Rapp | 297/148 X |
| 4,807,870 | 2/1989 | Hickman | 272/70.3 |
| 4,815,732 | 3/1989 | Mahvi | 272/143 X |
| 4,953,851 | 9/1990 | Sherlock et al. | 272/70.3 |

FOREIGN PATENT DOCUMENTS

| | | | |
|---|---|---|---|
| 1048148 | 11/1966 | United Kingdom | 272/70.3 |
| 1342397 | 1/1974 | United Kingdom | 135/67 |

*Primary Examiner*—Kenneth J. Dorner
*Assistant Examiner*—Milton Nelson, Jr.
*Attorney, Agent, or Firm*—Leon Gilden

[57] ABSTRACT

An upper and lower "U" shaped framework are secured together utilizing rear leg members and forward leg members extending downwardly from the framework to secure in a telescoping manner leg extensions thereto. The leg extensions utilize roller members at lower terminal ends thereof or alternatively, friction pads to provide stability of the organization when not in use as a walker structure. A tray member is selectively and securably mounted relative to the upper framework.

3 Claims, 4 Drawing Sheets

MOBILE CHAIR APPARATUS

BACKGROUND OF THE INVENTION

1. Field of the Invention

The field of invention relates to walker and seat structures for use by invalids and individuals of diminished ambulatory capacity for use in supporting such individuals in a manner to assist them in traversing distances.

2. Description of the Prior Art

Various walkers and the like have been utilized in the prior art to assist individuals that have difficulty in walking and maintaining balance. The instant invention sets forth a compact, lightweight, and convenient organization permitting individuals mobility otherwise denied. Examples of the prior art are exemplified in U.S. Pat. No. 4,415,198 to Brearley setting forth a seat structure for receiving individuals thereon that utilizes a flexible canvas-type seat support.

U.S. Pat. No. 4,532,948 to Burrows sets forth a walker formed with a flexible seat arranged as spaced "U" frameworks, with the seat structure suspended therebetween.

U.S. Pat. No. 4,345,790 to Coe sets forth a walker with a suspended flexible seat mounted within the walker framework.

Similarly, U.S. Pat. No. 4,907,839 to Rose, et al. sets forth a walker formed with a folding seat mounted within the walker structure.

As such, it may be appreciated that there continues to be a need for a new and improved walker apparatus as set forth by the instant invention which addresses both the problems of ease of use as well as in construction in permitting mobility to individuals of limited physical capacity and in this respect, the present invention substantially fulfills the need.

SUMMARY OF THE INVENTION

In view of the foregoing disadvantages inherent in the known types of walker apparatus now present in the prior art, the present invention provides a walker apparatus wherein the same utilizes a unitary web directed between upper and lower frameworks and seat belt structure to secure and position a torso portion of an individual within the seat structure. As such, the general purpose of the present invention, which will be described subsequently in greater detail, is to provide a new and improved walker apparatus which has all the advantages of the prior art walker apparatus and none of the disadvantages.

To attain this, the present invention provides an upper and lower "U" shaped framework secured together utilizing rear leg members and forward leg members extending downwardly from the framework to secure in a telescoping manner leg extensions thereto. The leg extensions utilize roller members at lower terminal ends thereof or alternatively, friction pads to provide stability of the organization when not in use as a walker structure. A tray member is selectively and securably mounted relative to the upper framework.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved walker apparatus which has all the advantages of the prior art walker apparatus and none of the disadvantages.

It is another object of the present invention to provide a new and improved walker apparatus which may be easily and efficiently manufactured and marketed.

It is a further object of the present invention to provide a new and improved walker apparatus which is of a durable and reliable construction.

An even further object of the present invention is to provide a new and improved walker apparatus which is susceptible of a low cost of manufacture with regard to both materials and labor, and which accordingly is then susceptible of low prices of sale to the consuming public, thereby making such walker apparatus economically available to the buying public.

Still yet another object of the present invention is to provide a new and improved walker apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
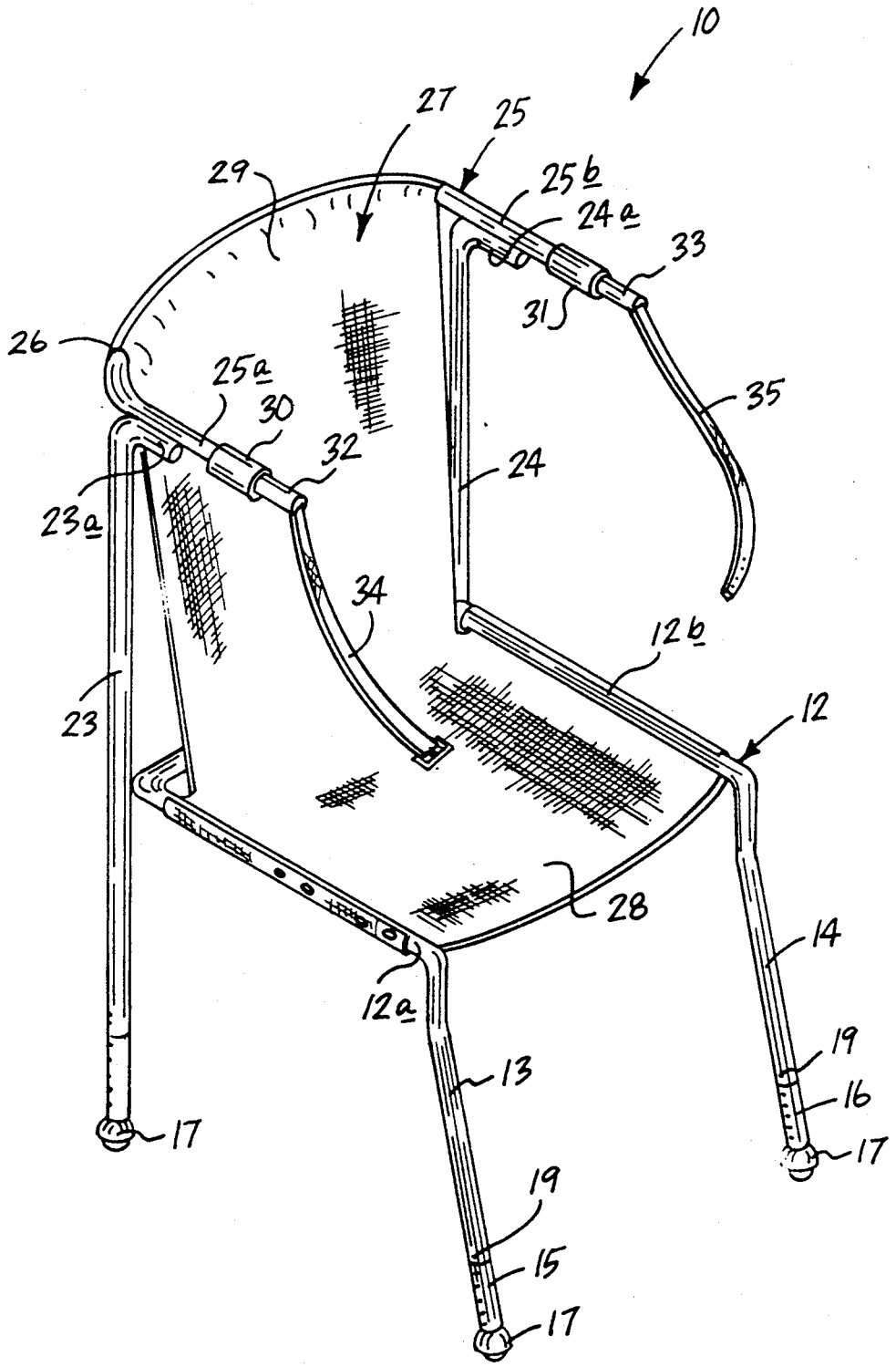
FIG. 1 is an isometric illustration of the instant invention.
Figure 2:
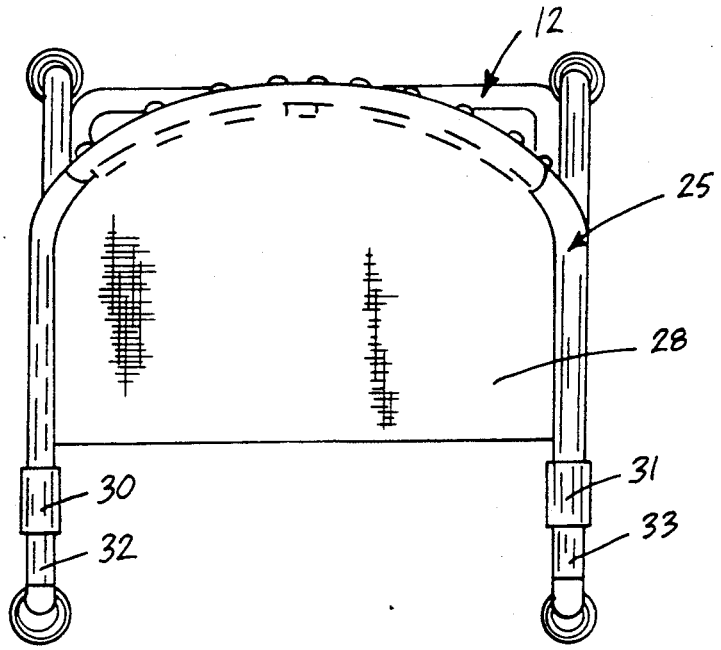
FIG. 2 is an orthographic top view of the instant invention.
Figure 3:
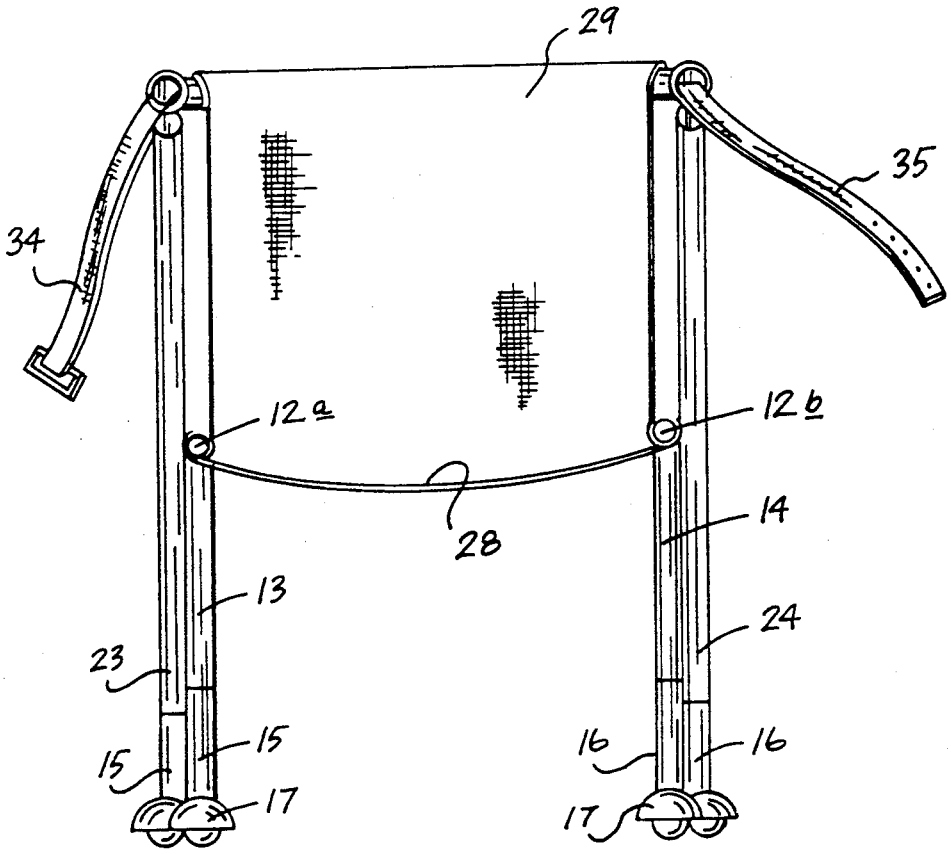
FIG. 3 is an orthographic frontal view, taken in elevation, of the instant invention.
Figure 4:
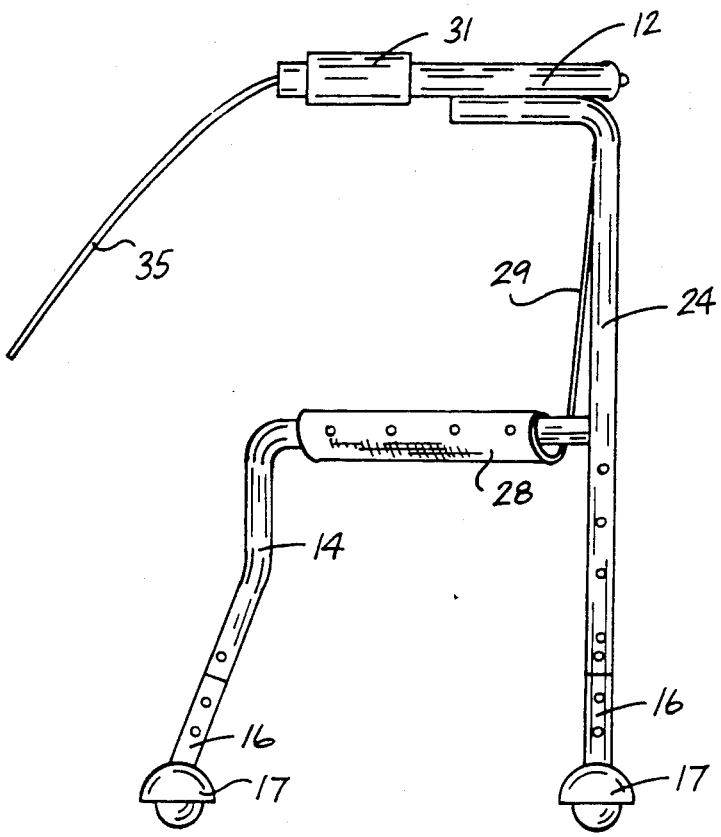
FIG. 4 is an orthographic side view, taken in elevation, of the instant invention.
Figure 5:
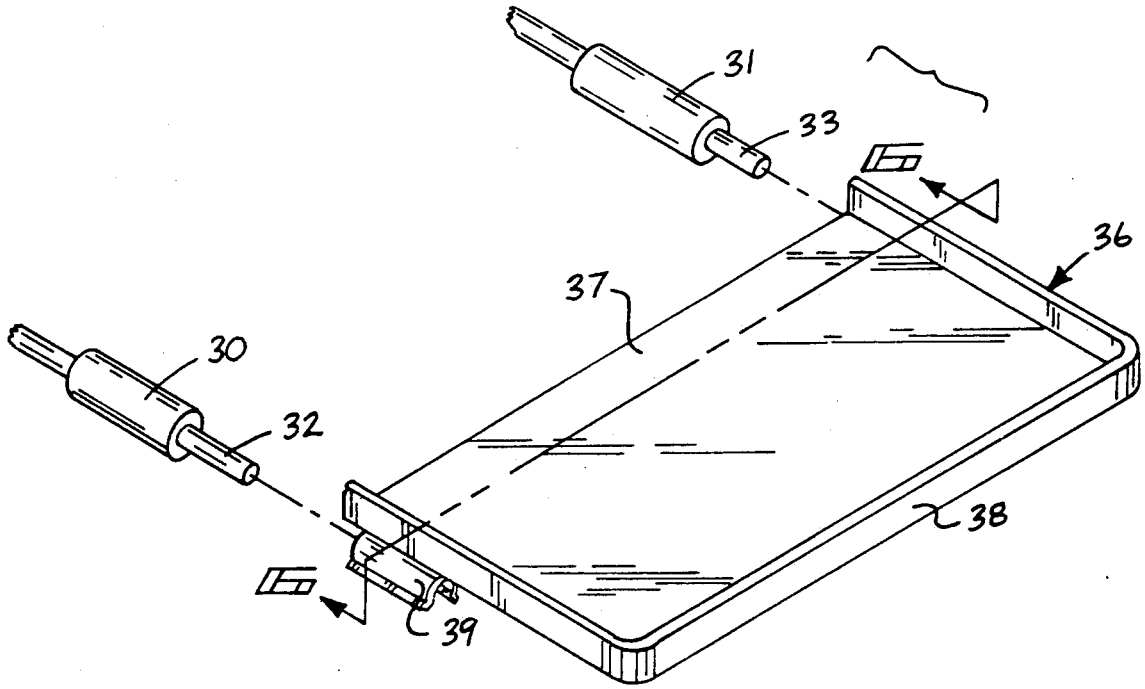
FIG. 5 is an isometric, exploded illustration, of the tray structure in association with the instant invention.
Figure 6:
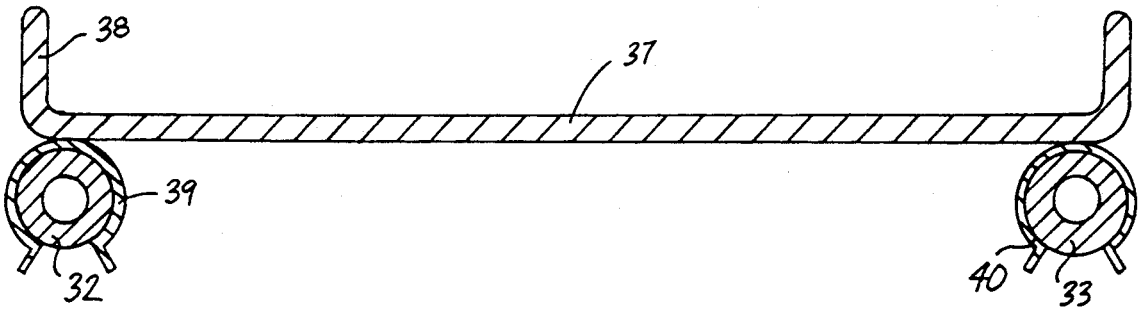
FIG. 6 is an orthographic view, taken along the lines 6—6 of FIG. 5 in the direction indicated by the arrows.

With reference now to the drawings, and in particular to FIGS. 1 to 8 thereof, a new and improved walker apparatus embodying the principles and concepts of the present invention and generally designated by the reference numeral 10 will be described.

More specifically, the walker apparatus 10 of the instant invention essentially comprises a lower "U" shaped horizontal seat frame 12 that includes a first lower horizontal frame leg 12*a* and a second lower horizontal frame leg 12*b* arranged parallel relative to one another formed with a respective first and second leg cylinder 13 and 14 extending downwardly relative to each forward end portion of the first and second lower horizontal frame legs 12*a* and 12*b*. Each of the first and second leg cylinders 13 and 14 respectively telescopingly receive a respective first and second leg extension therewithin. The leg extensions 15 and 16 mount roller members 17 at lower terminal ends thereof. Further, each of the leg extensions include leg extension apertures 18 directed therethrough that are selectively aligned with a plurality of leg cylinder apertures 19, including a lock pin 20 directed through the leg cylinder apertures 19 and one of a plurality of aligned leg extension apertures 18 to telescopingly position the leg extension relative to the leg cylinders.

Figure 7:
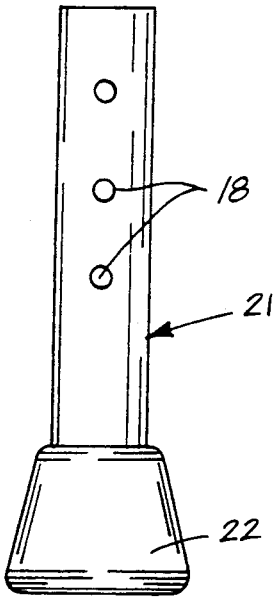
FIG. 7 an orthographic side view of a further leg extension utilizing a friction pad in lieu of wheels.
Figure 8:
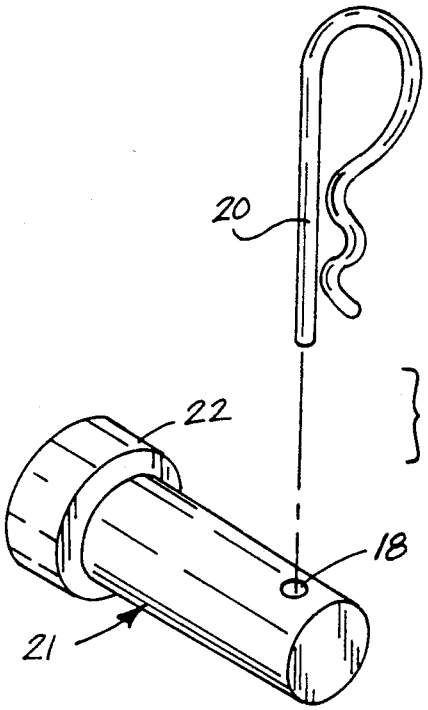
FIG. 8 is an isometric illustration of a typical clip structure utilized by the instant invention in mounting a leg extension into the leg cylinders of the framework of the instant invention.

FIGS. 7 and 8 illustrate the use of modified leg extensions 21 that utilize friction pads 22 at lower terminal ends thereof.

A first and second respective rear leg cylinder 23 and 24 are orthogonally mounted to each rear end portion of the first and second horizontal lower frame legs 12*a* and 12*b*, with the rear leg cylinders 23 and 24 extending orthogonally relative to the lower "U" shaped horizontal "U" shaped frame 12 and upwardly thereof terminating in respective first and second support legs 23 and 24. The first and second support legs 23 and 24 provide support for the mounting of "U" shaped upper horizontal frame 25 that is arranged parallel to and spaced from the lower "U" shaped horizontal frame 12. The upper horizontal frame 25 includes respective first and second upper horizontal frame legs 25*a* and 25*b* joined together at the rear end portions by arcuate connecting leg 26. A unitary seat web 27 is provided, wherein the unitary seat web 27 is formed with a horizontal web 28 and a vertical web 29. Opposed lateral sides of the horizontal web 28 include snap fasteners to secure the opposed sides of the horizontal web 28 to the first and second lower horizontal frame legs 12*a* and 12*b*. The vertical web 29 is formed with an upper edge that includes snap fasteners to secure the upper edge of the vertical web 29 to the arcuate connecting leg 26.

A respective right and left hand grip 30 and 31 is mounted at a forward terminal end of the first and second upper horizontal frame legs 25*a* and 25*b*, with a respective first and second upper frame leg extension 32 and 33 coaxially aligned with the first and second upper horizontal frame legs 25*a* and 25*b* and extending from the respective right and left hand grips 30 and 31 a predetermined length. To the first and second upper frame leg extensions 32 and 33, a respective first and second spring biased "C" shaped jaw pair are securable thereto, wherein each of the jaw pairs are of a length equal to the predetermined length and spaced apart a spacing equal to the spacing of the frame leg extensions 32 and 33. The "C" shaped jaw pairs 39 and 40 are mounted to a bottom surface of the tray member 36 at a bottom surface thereof. The tray member 36 includes a planar central support 37, with a "U" shaped support flange 38 extending upwardly from the central support 37 to the rear and side portions thereof. Further, a first and second flexible belt member 34 and 35 are mounted to forward terminal ends of the first and second upper frame leg extensions 32 and 33 to secure the torso of an individual and align the torso within the walker apparatus 10 of the instant invention.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A walker apparatus, comprising in combination, a lower "U" shaped horizontal seat frame, and an upper "U" shaped horizontal seat frame spaced above and parallel to the lower "U" shaped horizontal seat frame, and the lower "U" shaped horizontal seat frame including a first lower frame leg and a second lower frame leg arranged parallel relative to one another, with the lower horizontal seat frame including a first leg cylinder mounted fixedly and downwardly relative to a forward end portion of the first lower frame leg, and a second leg cylinder fixedly mounted to a forward end portion of the second lower frame leg, with the respective first and second leg cylinders telescopingly receiving a first and second leg extension therewithin, and the first and second leg extensions including a roller member mounted at a lower terminal end of each first and second leg extension, and a first rear leg cylinder orthogonally mounted adjacent a rear end portion of the first lower frame leg, and a second rear leg cylinder orthogonally mounted adjacent a rear end portion of the second lower frame leg, with the first and second rear leg cylinder extending upwardly of the lower "U" shaped horizontal seat frame to the "U" shaped upper horizontal seat frame, and each first and second rear leg cylinder telescopingly receiving a leg extension therewithin, wherein each leg extension mounts a roller member at a lower terminal end thereof, with each leg extension telescopingly receivable within the respective first and second rear leg cylinder, and a unitary seat web mounted to the lower "U" shaped horizontal seat frame and the upper "U" shaped horizontal seat frame, and the unitary seat web includes a vertical web, with the vertical web including an upper edge, and the upper edge mounted medially of the upper "U" shaped horizontal seat frame, and the unitary seat web including a horizontal web portion, with the horizontal web portion including spaced lateral side edges, wherein the side edges are mounted to the first and second lower frame legs, and snap fasteners permitting selective securement of the unitary seat web to the lower "U" shaped horizontal seat frame and the upper "U" shaped horizontal seat frame, and the upper "U" shaped horizontal seat frame includes a first upper horizontal frame leg and a second upper horizontal frame leg spaced apart a predetermined spacing arranged parallel relative to one another, and the first and second upper horizontal frame legs includes a respective right and left hand grip coaxially and orthogonally mounted to forward terminal ends of the respective first and second upper horizontal frame legs, and a first and second upper frame leg extension coaxially aligned to the first and second respective upper horizontal frame legs and mounted to a forward terminal end of the respective right and left hand grips, and a respective first and second flexible belt member mounted to forward terminal ends of the respective first and second upper frame leg extensions, wherein the first and second flexible belt members are arranged for securement of a torso portion of an individual into the apparatus.

2. An apparatus as set forth in claim 1 including a tray member, with the tray member including a planar central support, the planar central support includes a "U" shaped support flange fixedly and orthogonally mounted to the planar central support extending about opposed sides and rear edge of the planar central support, and a respective first and second "C" shaped spring biased jaw pair spaced apart the predetermined spacing and mounted to opposed sides of the planar central support, with the first and second "C" shaped spring biased jaw pairs securable to the respective first and second upper frame leg extensions.

3. An apparatus as set forth in claim 2 wherein the first and second rear leg cylinders each includes a support leg orthogonally mounted to each upper terminal end of each rear leg cylinder, wherein each support leg mounts the upper "U" shaped horizontal seat frame integrally thereon to provide an elongate support surface for the upper "U" shaped horizontal seat frame.

* * * * *